United States Patent [19]

Focke et al.

[11] Patent Number: 4,961,437

[45] Date of Patent: Oct. 9, 1990

[54] WRAPPING FOR BAGPACKS AND A PROCESS AND APPARATUS FOR PRODUCING IT

[75] Inventors: Heinz Focke; Oskar Balmer, both of Verden, Fed. Rep. of Germany

[73] Assignee: Focke & Co. (GmbH & Co.), Verden, Fed. Rep. of Germany

[21] Appl. No.: 772,502

[22] Filed: Sep. 4, 1985

[30] Foreign Application Priority Data

Sep. 13, 1984 [DE] Fed. Rep. of Germany ..... 3433608

[51] Int. Cl.[5] ..... A24C 5/00

[52] U.S. Cl. ..... 131/112; 131/115; 131/328; 131/329; 131/78

[58] Field of Search ..... 131/329, 112, 328, 115, 131/78

[56] References Cited

U.S. PATENT DOCUMENTS 2,508,962 5/1950 Moore .

FOREIGN PATENT DOCUMENTS 0540944 9/1954 Belgium .
3420023 12/1984 Fed. Rep. of Germany .
1107200 3/1968 United Kingdom .

*Primary Examiner*—V. Millin
*Attorney, Agent, or Firm*—Sughrue, Mion, Zinn, Macpeak & Seas

[57] ABSTRACT

It has not been possible hitherto to equip outer wrappings (10) for (tobacco) bagpacks of the twistbag type (11) with a tear-open thread or strip (15). The present wrapping (10) is provided with a tear-open strip (15) extending transversely relative to the longitudinal extension of the twisting (11). A longitudinal edge strip (17) with a longitudinal welding seam (18) is folded round against a wrapping wall (19,20) and fixed at the ends by transverse welding seams (21,22). A process and apparatus for producing such a twistbag.

9 Claims, 3 Drawing Sheets

19 (20)
19 (20)

WRAPPING FOR BAGPACKS AND A PROCESS AND APPARATUS FOR PRODUCING IT

BACKGROUND OF THE INVENTION

SUMMARY OF THE INVENTION

The invention relates to a wrapping consisting of weldable film for bagpacks intended for receiving cut tobacco or the like, especially twistbags consisting of at least one film forming a pouch composed of a front wall and rear wall connected to one another laterally by means of lateral welding seams, and with a twist tab joined to the rear wall, the wrapping enclosing the bagpack in the form of a U and wrapping walls thus formed being closed on three sides by longitudinal and transverse welding seams. The invention also relates to a process and an apparatus for producing bagpacks of this type with a wrapping.

There are two known versions of bagpacks for tobacco. As regards the twistbag, the walls of a film blank are laid flat on one another and connected to one another laterally by means of lateral welding seams to form the pouch. Laterally projecting side tabs are usually obtained in the region of these lateral welding seams. The rear wall of the pouch is provided with an extension, in particular the twist tab.

A side-folding bag, which is the other version of a bagpack, is provided with a bottom wall and corresponding side walls in the region of the pouch for receiving the cut tobacco. Thus, the pouch, when filled, acquires an approximately cuboid shape. This bagpack too is provided with a twist tab.

To improve the preservation of aroma and moisture, bagpacks of the type mentioned above have recently been provided with an (outer) wrapping consisting of thermally weldable film. A bagpack with wrapping of this type is described in G.B. patent specification No. 12 11 247. A blank of weldable film is laid round the bagpack in the form of a U and closed so as to be leak-proof by means of a longitudinal welding seam and two transverse welding seams. This wrapping design is appropriate for twistbags, that is to say for relatively shallow bagpacks. Wrappings consisting of films are also already known for side-folding bags. Here, as, for example, in the case of cigarette packs, the blank is laid round the side-folding bag and closed, at least in the region of the side walls, when folding tabs are folded round in trapezoidal form (envelope folding). The production of a wrapping of this type involves a high outlay in terms of time and machinery. Moreover, the above-mentioned type of film folding is not completely leak-proof. Where bagpacks of this type (side-folding bags) are concerned, it is already known to attach a tear-open strip or thread to the wrapping.

The invention is concerned with wrappings for bagpacks of the twistbag type. In practice, the wrappings are produced by laying a continuous film sheet in the form of a tube round the twistbags conveyed in the longitudinal direction. The continuous film tube is provided in a conventional way with a continuous tube seam extending approximately in the centre of the topside and the rearside of the twistbag. The twistbags are located at a distance from one another inside the film tube. Transverse separating welding is carried out in the region of these interspaces, as a result of which the closed wrappings are formed.

In this production method, it is not possible to attach a desired tear-open strip. Furthermore, because of the production cycle the wrappings do not match the dimensions of the twistbags with sufficient accuracy. The latter have too much play within the wrapping.

The object on which the invention is based is, therefore, to propose a further development of the wrapping for twistbags, in which the abovementioned disadvantages are avoided, that is to say, in particular, a tear-open strip can be attached in a simple way and it is also possible to match the dimensions of the wrapping exactly to those of the twistbag. The object of the invention is also to propose a suitable production process and an apparatus for producing wrappings of this type.

To achieve the object stated first, the wrapping according to the invention is characterised in that a longitudinal edge strip having the longitudinal welding seam of the wrapping is folded round against one of the wrapping walls and is connected to the latter by means of (partial) welding.

Accordingly, the construction of the wrapping is such that, in an intermediate position of the pack, a laterally projecting longitudinal edge strip is formed. According to the invention, this is folded round against one of the wrapping walls before the transverse welding seams are made. When the transverse welding seams are made, with the folded-round longitudinal edge strip being included at the same time, the latter is fixed in the abovementioned position. A very close-fitting wrapping is consequently possible, because, particularly as a result of the folding round of the longitudinal edge strip, the wrapping is drawn closely up against the pack content.

The apparatus for attaching and completing the wrapping comprises a rotating turret with pockets, each receiving a twistbag with a wrapping. In a first pushing-in station, the twistbag is transported into a pocket of the turret along a (horizontal) feed track, at the same time carrying along and wrapping in the form of a U a blank provided for the wrapping. In this pushing-in station, excess lengths of wrapping which project from the pocket are then welded together to form the longitudinal edge strip with the longitudinal welding seam.

During further transport as a result of the rotation of the turret, the projecting longitudinal edge strip is first angled into an intermediate position and then, in a welding station, laid against the wrapping wall and welded laterally by means of the transverse welding seams.

According to the invention, the wrapping blank is severed from a continuous film sheet. This is provided (off-centre) with a continuous tear-open strip and a gripping tab.

BRIEF DESCRIPTION OF THE DRAWINGS

A bagpack with a wrapping, a production process and an apparatus according to the invention are explained in more detail below with reference to the drawings. In the drawings.

DETAILED DESCRIPTION OF A PREFERRED EMBODIMENT

Figures 1, 2, 3, 4, 5:
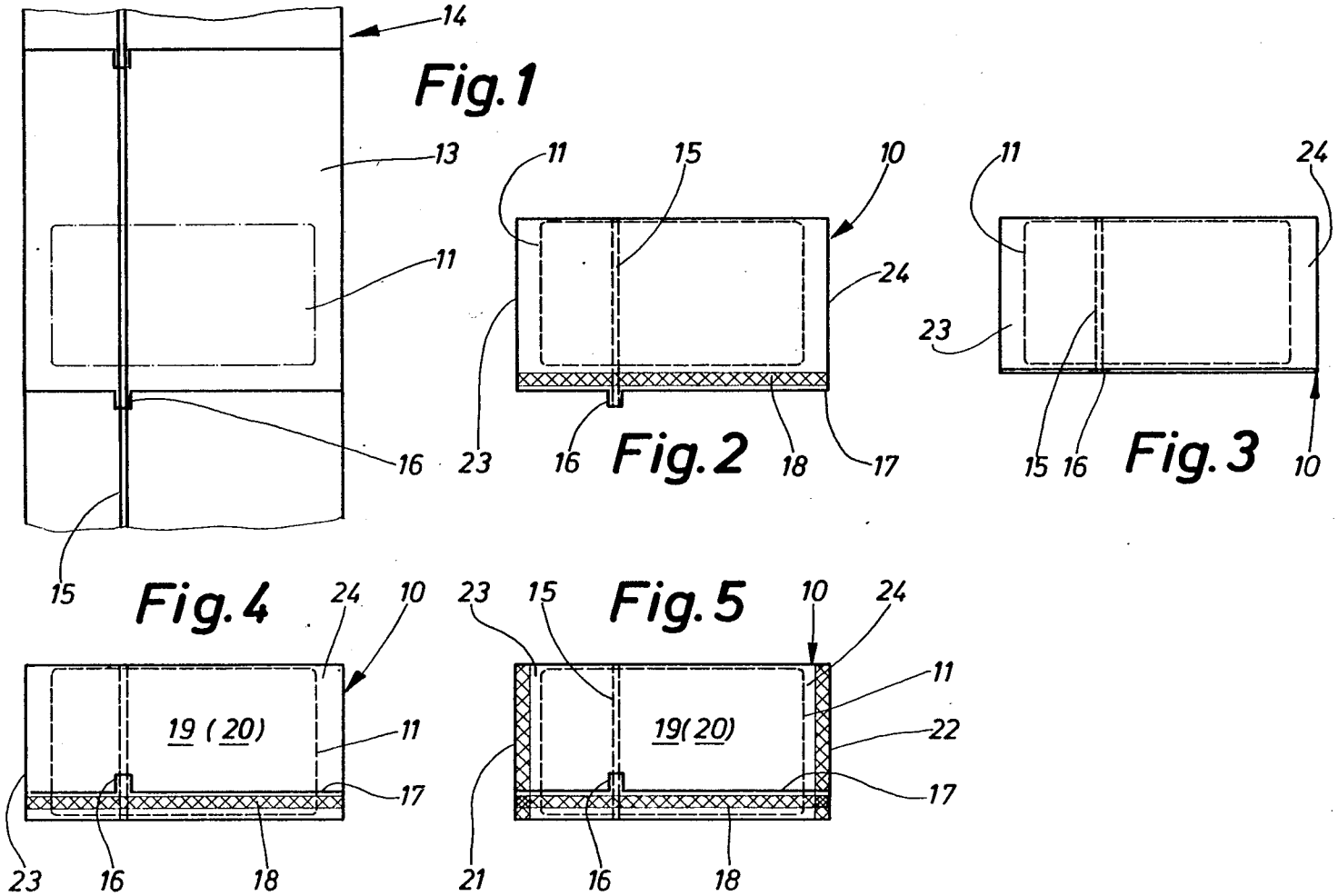
FIG. 1 shows a portion of a film sheet for producing wrapping blanks.
FIG. 2 shows a bagpack with a wrapping after a longitudinal welding seam has been made.
FIG. 3 shows the bagpack according to FIG. 2 after a longitudinal edge strip has been folded initially.
FIG. 4 shows the bagpack after the longitudinal edge strip has been folded round.
FIG. 5 shows the bagpack with a completed wrapping.

The exemplary embodiment illustrated in the drawings relates to the production of a wrapping 10 consisting of thermally weldable film and to its attachment to a twistbag 11.

The twistbag 11 is of customary design, conventionally consisting of a shallow cushion-shaped pouch 12 for receiving the cut tobacco. Further details are not reproduced in the drawings for the sake of simplification.

The wrapping 10 consists of a rectangular wrapping blank 13. This is severed from a continuous film sheet 14 (FIG. 1) in the width of the wrapping blank 13. A tear-open strip 15 extends, off-centre here, in the longitudinal direction of the film sheet 14. When the wrapping blank 13 is severed, a gripping tab 16 is made in the region of the tear-open strip 15. The wrapping blank 13 and consequently the film sheet 14 are somewhat wider than the twistbag 11.

To form the wrapping 10, the wrapping blank 13 is laid round the twistbag 11 in the form of a U in such a way that a projecting longitudinal edge strip 17 (FIG. 2) is formed on one longitudinal side of the latter. A longitudinal welding seam 18 extends in the region of this longitudinal edge strip 17 (FIG. 2). After the above-mentioned longitudinal welding seam 18 has been made, the longitudinal edge strip 17 is folded round (FIG. 3) until it comes up against one of two wrapping walls 19 and 20 (FIG. 4). In this intermediate position, transverse welding seams 21 and 22 (FIG. 5) are made in the region of transverse edge strips 23 and 24 of the wrapping 10 outside the region of the wrapped twistbag. The welding seams 18 and 21,22, at least when they are made, are located outside the region of the twistbag 11. When the longitudinal edge strip 17 is folded round, the wrapping 10 is drawn closely up against the twistbag 11 transversely relative to the latter. When the transverse welding seams 21,22 are made, the longitudinal edge strip 17 is fixed in the folded-round position because the ends of the latter are tied in the transverse welding seams 21,22. The arrangement is such that the wrapping wall 20 carrying the gripping tab 16 is located on the outside, so that the gripping tab 16 can easily be grasped as a projecting excess length.

Figure 6:
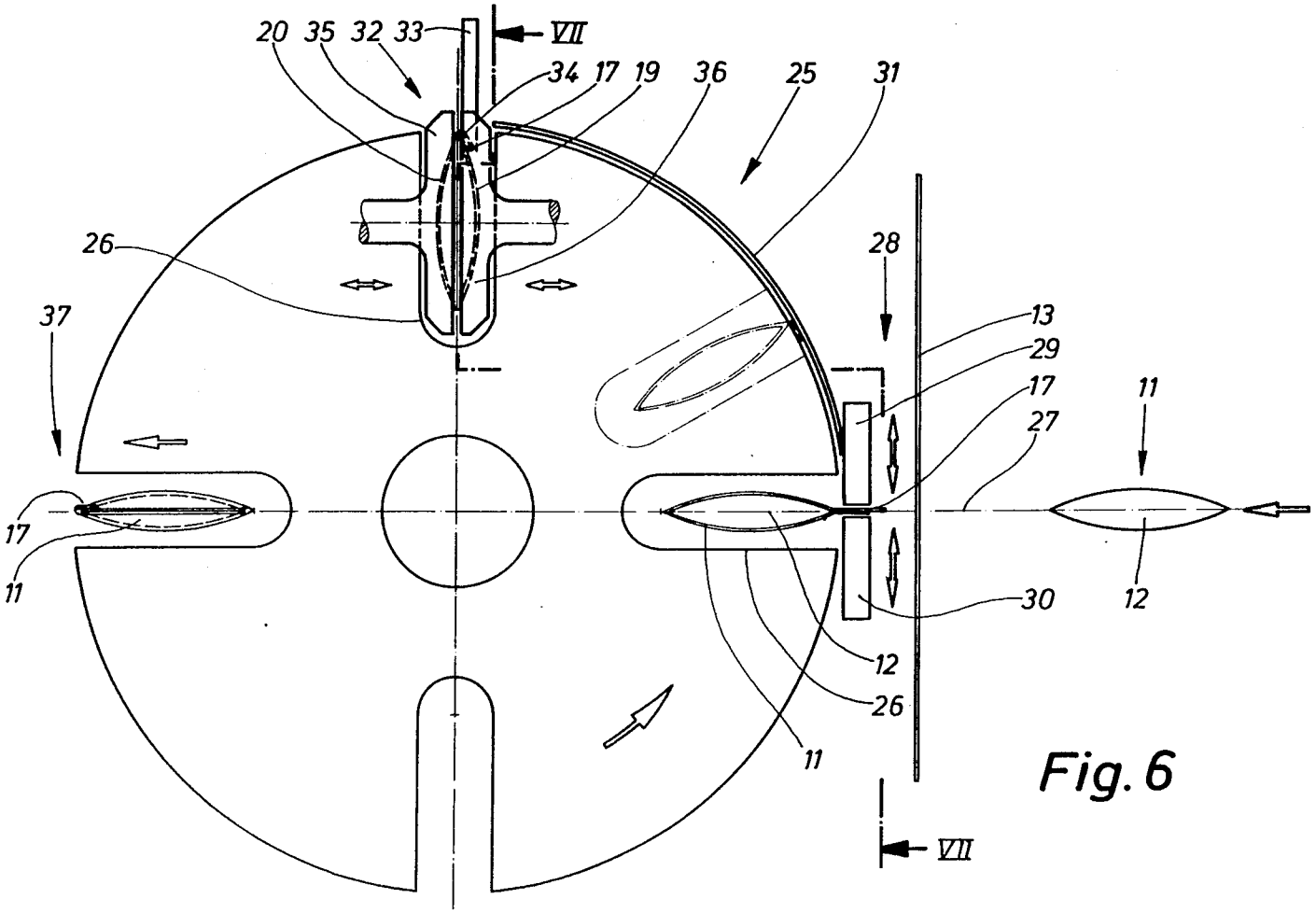
FIG. 6 shows, in a diagrammatic side view, an apparatus, in particular a turret, for attaching and closing wrappings.
Figure 7:
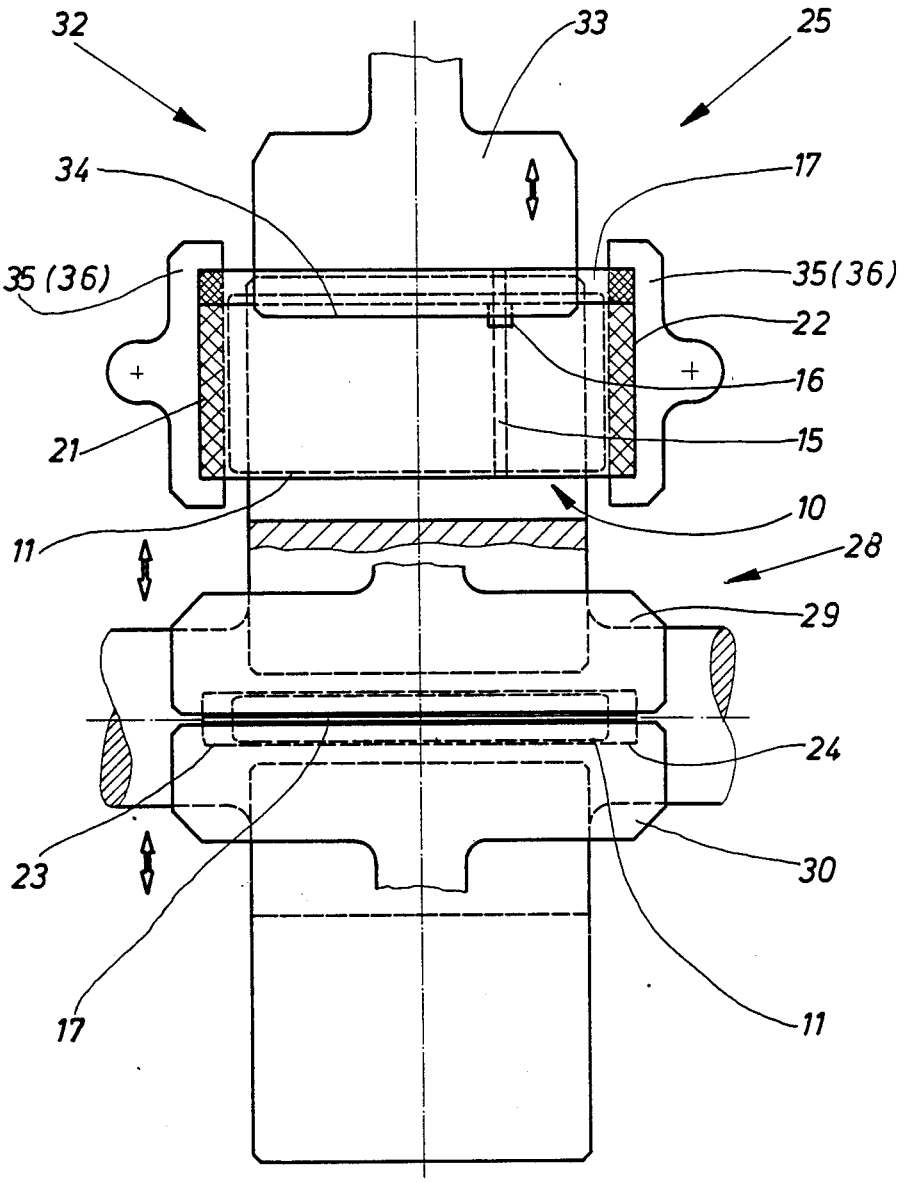
FIG. 7 shows details of the turret according to FIG. 6, in particular a section in the planes VII—VII of FIG. 6.

To produce the wrapping 10 and to attach and close it, the apparatus (packaging machine) is equipped with a turret 25 (FIGS. 6 and 7). In the present case, this is driven to rotate intermittently in a vertical plane. The turret is provided with several, in the present case four radially directed pockets 26, each receiving a twistbag 11 with a wrapping 10.

The twistbags 11 which are finished, in particular closed and, if appropriate, provided with a revenue stamp, are supplied to the turret 25 along a (horizontal) feed track 27 (FIG. 6) and, in the region of a pushing-in station 28, are pushed into a pocket 26 provided, this being open on the radially outer side. During the pushing-in movement, a wrapping blank 13 provided (tangentially) in a vertical plane adjacent to the turret 25 is carried along by the twistbag 11, in such a way that the wrapping blank 13 is laid round the twistbag 11 in the form of a u and enters the pocket 26 together with the latter.

The design and dimensions of the pockets 26 are such that after a twistbag 11 has been received, excess lengths of the wrapping blank 13 project from the pocket 26 and protrude radially to form the longitudinal edge strip 17. As a result, in the region of the pushing-in station 28, the longitudinal welding seam 18 can be made by means of longitudinal welding jaws 29 and 30 (FIG. 6) movable from above and below in a tangential direction against the longitudinal edge strip 17.

The turret 25 is then moved one stroke, that is to say one division, further. During the rotary movement, the pocket 26 together with the twistbag 11 passes into the region of a fixed guide wall 31 which is in the form of a circular arc and which conforms closely to the outer periphery of the turret 25. When the projecting longitudinal edge strip 17 enters the region of this guide wall 31, it is folded round into an intermediate position (approximately at right angles to the twistbag 11) pointing to the rear and-in the peripheral direction of the turret 25.

The twistbag 11, together with the pocket 26 receiving it, now passes into a welding station 32 (FIGS. 6 and 7). Here, the longitudinal edge strip 17 already projecting transversely is first grasped by a fixed folding blade 33 movable to and fro radially and having a sloping folding edge 34 and is folded round against the wrapping wall 19 which is at the rear in the direction of rotation. The longitudinal edge strip 17 is fixed in this position by the folding blade 33.

Pairs of transverse welding jaws 35 and 36 arranged on both sides of the turret are now activated. These are moved towards one another to press toether the transverse edge strips 23 and 24 and weld them to one another as a result of the formation of the transverse welding seams 21 and 22. For this purpose, the dimensions of the pockets 26 or the dimensions of the turret 25 in the axial direction are such that the twistbags 11 or wrappings 10 located in the pockets 26 project laterally out of the pocket by means of the transverse edge strip 23, 24. The longitudinal dimensions of the pockets 26 or of the turret 25 therefore correspond exactly to the longitudinal dimensions of the twistbag 11. Transverse welding seams 21,22 resting close against the twistbag 11 can consequently be made by the transverse welding jaws 35,36.

The transverse welding jaws 35 and 36 moved towards one another also grasp the end regions of the folded-round longitudinal edge strip 17 and weld the latter in the region of the transverse welding seams 21,22, so that the folded-round position is fixed.

The turret 25 is then moved further until the now finished pack (twistbag 11 with the wrapping 10) enters a pushing-out station 37 (FIG. 6). Here, the twistbag 11 is ejected from the pocket 26 in a radial direction onto a discharge conveyor track not shown in detail.

Because the longitudinal welding seam 18 and the transverse welding seams 21,22 are each made during a stationary phase, these seams can be placed very close to the content, that is to say to the twistbag 11. The dimensions of the turret 25 are such that, as is evident from FIG. 7, lateral regions of the twistbag and consequently the transverse edge strips 23,24 project freely from the pockets 26. The transverse welding jaws 35,36 can consequently make the transverse welding seams 21,22 with precision immediately next to the twistbag 11.

What is claimed is:

1. Process for producing wrappings consisting of weldable film, each receiving a twist-bag, a wrapping blank (13) first being laid round the twistbag in the form of a U, and projecting edge regions, including longitudinal edge strips and transverse edge strips, being welded to one another, said process comprising the steps of: after the wrapping blank (13) has been folded round the twistbag in the form of a U, first making the longitudinal welding seam (18) in the region of the longitudinal edge strip (17); then folding the longitudinal edge strip (17) round against one of the wrapping walls (19, 20); and finally making the transverse welding seams (21, 22) in the region of the transverse edge strips (23, 24) so that opposite ends of the folded-found longitudinal edge strip (17) are welded at the same time to said one wrapping wall.

2. Process according to claim 1, comprising the step of severing the wrapping blank (13) from a continuous film sheet (14), with a tear-open strip (15) extending in the longitudinal direction of the latter and with a gripping tab (16) in the region of the tear-open strip (15), in such a way that the tear-open strip (15) surrounds the twistbag (11) together with the finished wrapping (20) transversely relative to its longitudinal extension.

3. Apparatus for producing wrappings consisting of weldable film for twistbags, a wrapping blank laid round the twistbag in the form of a U being provided in the region of a longitudinal edge strip with a longitudinal welding seam and in the region of transverse edge strips with transverse welding seams, characterised by a rotating turret (25) with several pockets (26), each receiving a twistbag (11) with a wrapping blank (13), the twistbag (11) being conveyed into a pocket (26) in a pushing-in station (28) in such a way that a wrapping blank (13) can also be introduced into the pocket (26), at the same time being laid against the twistbag (11) in the form of a U, and excess lengths of film projecting in a radial direction from the pocket (26) of the turret (25) to form the longitudinal edge strip (17).

4. Apparatus according to claim 3, characterized in that, to form the longitudinal edge strip (17), there are provided welding jaws for welding the excess lengths of film to one another in the pushing-in station (28), thereby forming the longitudinal welding seam (18), said longitudinal welding jaws (29, 30) being movable relative to one another in a tangential direction.

5. Apparatus according to claim 4, characterised in that, as a result of further transport by (rotation of the turret (25), the longitudinal edge strip (17) is folded round against the periphery of the turret (25) into an intermediate position by a fixed guide wall (31) extending over a part-periphery of the turret (25).

6. Apparatus according to claim 5, characterised in that, in a welding station (32) of the turret (25), the longitudinal edge strip (17) is folded round by a folding blade (33) out of the transversely directed intermediate position until it comes up against one of the wrapping walls (19,2O), and in that the transverse welding seams (21,22) can be made by means of transversely movable transverse welding jaws (35,36) in the region of transverse edge strips (23,24) projecting laterally beyond the turret (25).

7. Apparatus according to claim 6, characterised in that the folding blade (33) is movable in the region between the movable transverse welding jaws (35,36) arranged laterally next to the turret (25).

8. Wrapping for enclosing twistbags containing tobacco or the like, said wrapping being formed by a weldable film which is folded in the form of an U, said wrapping comprising top and bottom walls (19, 20) integrally connected at a longitudinal rear edge and having two transverse edges (23, 24) and a longitudinal front edge (17), wherein said top and bottom walls (19, 20) are welded together along both said longitudinal front edge and also said transverse edges to form a longitudinal seam (18) and two transverse welding seams (21, 22), said longitudinal welding seam (18) and a front edge portion of said transverse welding seams (21, 22) being folded round against one (19) of said walls (19, 20), and opposite ends of said longitudinal welding seam (18) being welded at said transverse welding seams (21, 22) in a folded position to said one wall (19) so that said ends of said longitudinal welding seam (18) are fixed in the folded position against said one wall (19).

9. Wrapping according to claim 8, characterised by a tear-open strip (15) extending transversely relative to the longitudinal welding seam (18), and a gripping tab (16) on the free folded-round edge of the longitudinal edge strip (17).

* * * * *